US010377606B2

(12) United States Patent
Martí

(10) Patent No.: US 10,377,606 B2
(45) Date of Patent: Aug. 13, 2019

(54) ELEVATOR SAFETY GEAR GUIDING ASSEMBLY AND METHOD

(71) Applicants: OTIS ELEVATOR COMPANY, Farmington, CT (US); Luis Martí, Madrid (ES)

(72) Inventor: Luis Martí, Madrid (ES)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/565,068

(22) PCT Filed: Apr. 10, 2015

(86) PCT No.: PCT/EP2015/057833
§ 371 (c)(1),
(2) Date: Oct. 6, 2017

(87) PCT Pub. No.: WO2016/162082
PCT Pub. Date: Oct. 13, 2016

(65) Prior Publication Data
US 2018/0118516 A1 May 3, 2018

(51) Int. Cl.
*B66B 5/22* (2006.01)
*B66B 5/18* (2006.01)

(52) U.S. Cl.
CPC . *B66B 5/22* (2013.01); *B66B 5/18* (2013.01)

(58) Field of Classification Search
CPC ..... B66B 5/22; B66B 5/18
See application file for complete search history.

(56) References Cited

U.S. PATENT DOCUMENTS 3,481,432 A * 12/1969 Walter ..... B66B 5/18 187/375
3,830,344 A * 8/1974 Cervenec ..... B66B 29/00 188/171
5,518,087 A * 5/1996 Hwang ..... B66B 5/18 187/374

(Continued)

FOREIGN PATENT DOCUMENTS

AT 297260 7/1971
CN 2437654 Y 7/2001

(Continued)

OTHER PUBLICATIONS

International Search Report and Written Opinion regarding related PCT App. No. PCT/EP2015/057833; dated Dec. 17, 2015.

*Primary Examiner* — Michael A Riegelman
(74) *Attorney, Agent, or Firm* — Cantor Colburn LLP

(57) ABSTRACT

An elevator safety gear assembly includes a base plate having a guiding component. Also included is a first engagement member operatively coupled to the base plate and configured to be positioned on a first side of a guide rail. Further included is a second engagement member operatively coupled to the base plate and configured to be positioned on a second side of a guide rail. Yet further included is a connector operatively coupled to the first engagement member and the second engagement member for symmetric movement of the first engagement member and the second engagement member relative to the guide rail, the connector having a guiding element disposed in engagement with the guiding component of the base plate.

9 Claims, 2 Drawing Sheets

(56) References Cited

U.S. PATENT DOCUMENTS

| | | | | |
|---|---|---|---|---|
| 5,739,610 | A * | 4/1998 | Nemoto | F16D 55/2245 188/158 |
| 6,021,872 | A * | 2/2000 | Sevilleja | B66B 5/027 187/266 |
| 6,318,505 | B1 * | 11/2001 | De Angelis | B66B 11/0293 187/292 |
| 8,931,598 | B2 * | 1/2015 | Aguado | B66B 5/044 182/234 |
| 9,321,610 | B2 * | 4/2016 | Fargo | B66B 7/041 |
| 2007/0170010 | A1 * | 7/2007 | Higashinaka | B66B 5/18 187/374 |
| 2007/0170014 | A1 * | 7/2007 | Woronoff | B66B 5/16 187/414 |
| 2007/0272503 | A1 * | 11/2007 | Kigawa | B66B 5/18 187/379 |
| 2013/0213750 | A1 | 8/2013 | Meierhaus et al. | |
| 2014/0224593 | A1 | 8/2014 | Ascua et al. | |

FOREIGN PATENT DOCUMENTS

| | | | |
|---|---|---|---|
| CN | 203568627 | U | 4/2014 |
| CN | 104229589 | A | 12/2014 |
| EP | 0968954 | B1 | 5/2003 |
| EP | 1294631 | B1 | 8/2004 |
| EP | 1955973 31 | | 4/2010 |
| EP | 1670710 | B1 | 12/2010 |
| EP | 1167269 | B1 | 3/2012 |
| EP | 2084094 | B1 | 4/2014 |
| EP | 2725257 | A1 | 4/2014 |
| EP | 2814769 | A1 | 12/2014 |
| EP | 2814769 | B1 | 12/2015 |
| WO | 2013035175 | A1 | 3/2013 |

* cited by examiner

ELEVATOR SAFETY GEAR GUIDING ASSEMBLY AND METHOD

CROSS-REFERENCE TO RELATED APPLICATIONS

This patent application is a National Stage Application of International Patent Application Serial No. PCT/EP2015/057833 filed on Apr. 10, 2015, which is incorporated herein by reference in its entirety.

BACKGROUND OF THE INVENTION

The embodiments herein relate to elevator systems and, more particularly, to an elevator safety gear guiding assembly, as well as a method of guiding an elevator safety gear assembly.

Elevator systems often include a hoisted structure (e.g., elevator car), a counterweight, a tension member (e.g., rope, belt, cable, etc.) that connects the hoisted structure and the counterweight. During operation of such systems, a safety gear is configured to assist in braking the elevator car relative to a guide member, such as a guide rail, in the event the elevator car exceeds a predetermined velocity or acceleration. The safety gear includes at least one engagement member that is configured to engage the guide member, if needed.

Safety gears may be of the non-symmetrical or symmetrical type. In a symmetrical type of safety gear, two engagement members are located proximate the guide rail and on opposite sides of the guide rail. A connector is required to synchronize the movement of the engagement members upon actuation of the engagement members. The connector can be located above the engagement members or below the engagements members. A connector located above the engagement members advantageously provides a pulling actuation force, thereby facilitating better self-alignment of the engagement members, when compared to a pushing actuation force generated from a connector located below the engagement members. However, there is often more room for a connector below the engagement members. Therefore, locating the connector below the engagement members reduces the impact of the connector on the overall elevator system layout. Unfortunately, the designs of a connector located below the engagement members are more complex, expensive and/or bulky, due to the enhanced functional requirements associated with a pushing actuation force.

BRIEF DESCRIPTION OF THE INVENTION

According to one embodiment, an elevator safety gear assembly includes a base plate having a guiding component. Also included is a first engagement member operatively coupled to the base plate and configured to be positioned on a first side of a guide rail. Further included is a second engagement member operatively coupled to the base plate and configured to be positioned on a second side of a guide rail. Yet further included is a connector operatively coupled to the first engagement member and the second engagement member for symmetric movement of the first engagement member and the second engagement member relative to the guide rail, the connector having a guiding element disposed in engagement with the guiding component of the base plate.

In addition to one or more of the features described above, or as an alternative, further embodiments may include that the connector comprises a linkage assembly.

In addition to one or more of the features described above, or as an alternative, further embodiments may include that the connector comprises a first linkage member and a second linkage member, the first linkage member operatively coupled to the first engagement member at a first linkage first end, the second linkage member operatively coupled to the second engagement member at a second linkage first end, and the first linkage member and the second linkage member operatively coupled to each other.

In addition to one or more of the features described above, or as an alternative, further embodiments may include that the first linkage member and the second linkage member are operatively coupled to each other at a pivot axis.

In addition to one or more of the features described above, or as an alternative, further embodiments may include that the pivot axis is located at a first linkage second end and a second linkage second end.

In addition to one or more of the features described above, or as an alternative, further embodiments may include that the guiding element is co-axially located with the pivot axis.

In addition to one or more of the features described above, or as an alternative, further embodiments may include that the guiding element of the connector comprises a protrusion and the guiding component of the base plate comprises a slot defined by the base plate, the guiding element disposed within the slot.

In addition to one or more of the features described above, or as an alternative, further embodiments may include that the slot extends in a vertical direction of the base plate, the vertical direction defined by a direction of travel of an elevator car that the elevator safety gear assembly is coupled to.

In addition to one or more of the features described above, or as an alternative, further embodiments may include that the connector is located below the first engagement member and the second engagement member.

In addition to one or more of the features described above, or as an alternative, further embodiments may include that the connector is operatively coupled to the first engagement member and the second engagement member proximate respective lower ends of the first engagement member and the second engagement member.

In addition to one or more of the features described above, or as an alternative, further embodiments may include that engagement between the guiding element and the guiding component constrains movement of the guiding element to vertical movement.

In addition to one or more of the features described above, or as an alternative, further embodiments may include that the first engagement member and the second engagement member each comprises a wedge member, the wedge members configured to symmetrically engage the guide rail.

In addition to one or more of the features described above, or as an alternative, further embodiments may include that the first engagement member and the second engagement member each comprises a roller member, the roller members configured to symmetrically engage the guide rail.

According to another embodiment of the invention, a method of guiding an elevator safety gear assembly is provided. The method includes operatively coupling a connector to a first engagement member and a second engagement member. The method also includes constraining movement of a guiding element of the connector to vertical movement by retaining the guiding element within a slot defined by a back plate of the elevator safety gear assembly.

In addition to one or more of the features described above, or as an alternative, further embodiments may include that the connector comprises a linkage having a first linkage member and a second linkage member operatively coupled to each other at a pivot axis, the guiding element of the connector located co-axially with the pivot axis.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

Figure 1:
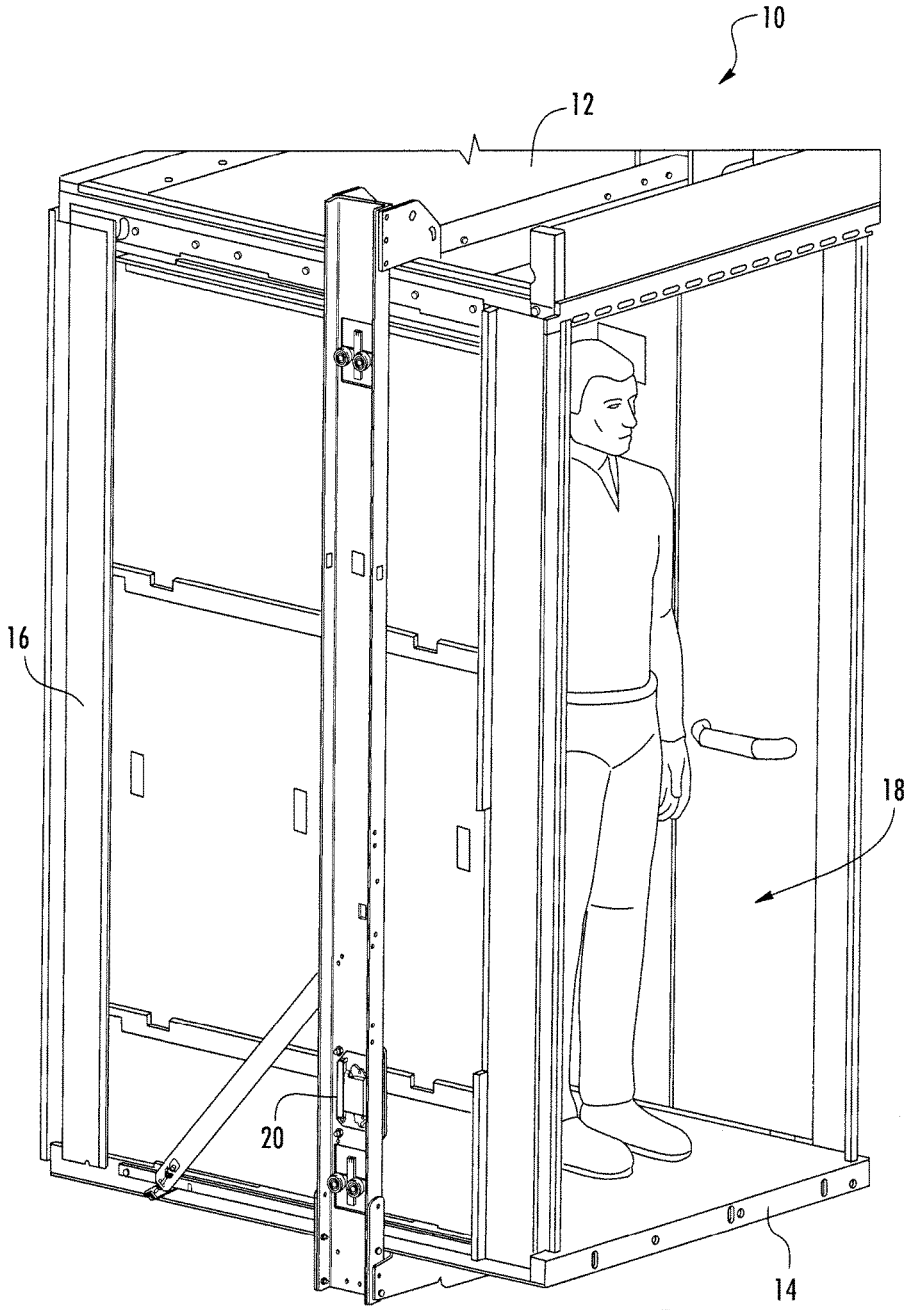
FIG. 1 is a perspective view of an elevator car.

Referring to FIG. 1, an elevator car 10 is illustrated. The elevator car 10 moves along guide rails of an elevator shaft in a known manner. The elevator car 10 is disposed within the elevator shaft and is moveable therein, typically in a vertical manner. The elevator car 10 includes a car roof 12, a car floor 14 and a plurality of side walls 16. Together, the car roof 12, the car floor 14 and the plurality of side walls 16 define an interior region 18 that is dimensioned to carry standing passengers and/or cargo during operation of the elevator car within the overall elevator system. A safety gear assembly 20 is generally illustrated and is positioned to engage the guide rail in the event of a safety braking event. The safety gear assembly 20 is operable to assist in braking (e.g., slowing or stopping movement) of the elevator car 10 relative to a guide member, as will be described in detail below.

Figure 2:
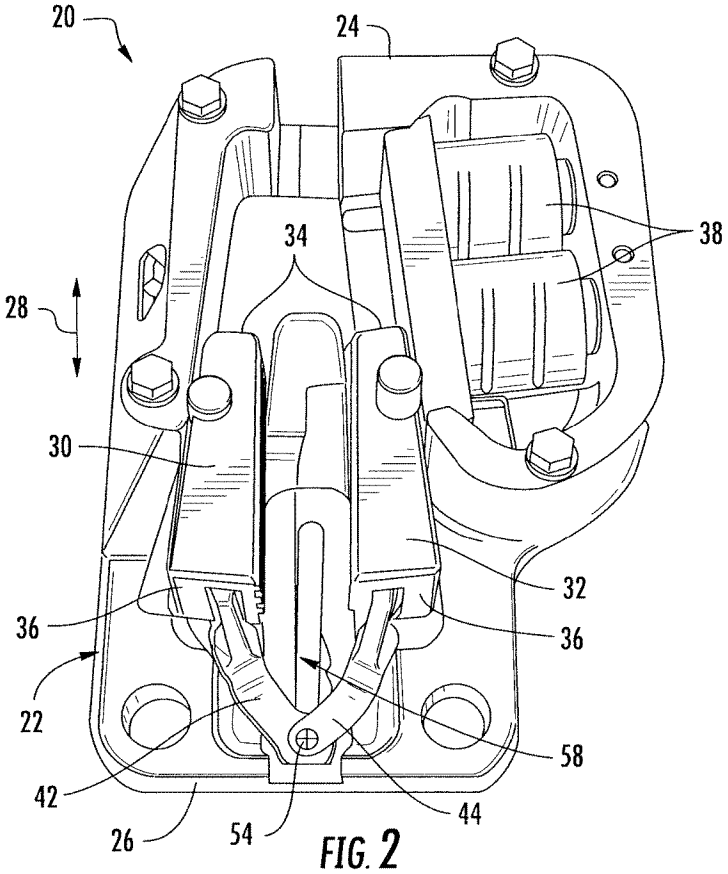
FIG. 2 is a perspective view of a safety gear assembly.

Referring to FIG. 2, the safety gear assembly 20 is illustrated in greater detail. The safety gear assembly 20 includes a base plate 22 that other components may be operatively coupled to, or integrally formed with, in order to form the overall safety gear assembly. The base plate 22 is operatively coupled to the elevator car 10 to secure the overall safety gear assembly to the elevator car 10. The base plate 22 includes a top end 24 and a bottom end 26, with a vertical direction 28 extending between the top end 24 and the bottom end 26. The vertical direction 28 is defined by a direction of travel of the elevator car 10.

The safety gear assembly 20 includes a first engagement member 30 and a second engagement member 32. The first engagement member 30 and the second engagement member 32 are each operatively coupled to the base plate 22 and are positioned on opposite sides of the guide rail in close proximity to, but spaced from, the guide rail. In particular, the first engagement member 30 is positioned on a first side of the guide rail and the second engagement member 32 is positioned on a second, and opposite, side of the guide rail.

In the illustrated embodiment, the first engagement member 30 and the second engagement member 32 are wedge members, but it is to be appreciated that alternative components that are suitable for frictional engagement with the guide rail are contemplated. For example, roller members may be employed to engage the guide rail, thereby facilitating adequate braking of the elevator car 10. Irrespective of the precise type of engagement members employed, the first engagement member 30 and the second engagement member 32 each include a top side 34 and a bottom side 36. The safety gear assembly 20 includes one or more elastic members 38, such as springs, to control the normal force associated with the second engagement member 32 and the guide rail upon detection of an event that requires the use of the engagement members 30, 32. One or more actuating members (not illustrated) pull the engagement member 32 to actuate movement required to engage the second engagement member 32, and therefore the first engagement member 30, with the guide rail. The actuating member(s) may be electric, electronic, mechanical, or a combination of these.

The arrangement of the first and second engagement members 30, 32 is referred to as a symmetric arrangement, based on the positioning of the engagement members 30, 32 on opposite sides of the guide rail. In such an arrangement, it is important to synchronize the movement of the engagement members subsequent to actuation of the engagement members. In operation, the actuation member(s) 38 directly actuate only one of the two engagement members 30, 32. In the illustrated embodiment, the actuation member(s) 38 directly actuate the second engagement member 32. The direct actuation of the single engagement member needs to be transferred indirectly to the other engagement member, but in a manner that facilitates the desired symmetric movement of the engagement members, as described above. It is to be appreciated that completely symmetric operation is not required, as there may be a small asymmetrical displacement of members 30, 32 due to the fact that elastic members 38 are located only on one side of the assembly and its small compression may result in small asymmetry in the members' movement. The arrangement is referred to as "symmetric" based on the extent of asymmetry being considered negligible.

Figure 3:
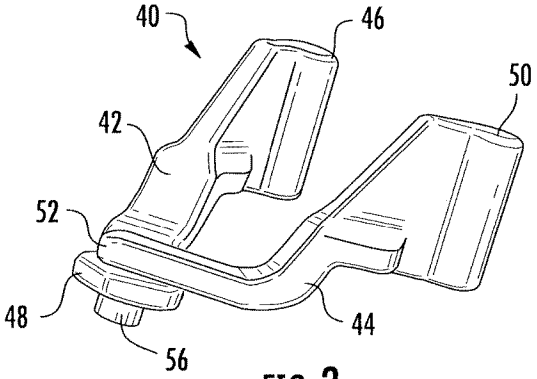
FIG. 3 is a perspective view of a connector of the safety gear assembly.

Referring now to FIG. 3, with continued reference to FIG. 2, a connector 40 is provided to operatively couple the first engagement member 30 to the second engagement member 32 to actuate movement of the first engagement member 30 subsequent to direct actuation of the second engagement member 32 by the actuation member(s) 38. This is done while maintaining symmetric movement of the engagement members. The connector 40 is located below the first and second engagement members 30, 32, as will be appreciated from the description herein. The connector 40 is a linkage assembly formed of a first linkage member 42 and a second linkage member 44 in the illustrated embodiment, but it is to be understood that more or less linkage members may be included to form the connection between the first and second engagement members 30, 32. Although illustrated and described herein as a linkage assembly, it is to be understood that the connector 40 may be a single component. In such an embodiment, the single component is sufficiently flexible to avoid the need for a pin joint or the like.

The first linkage member 42 extends from a first linkage first end 46 to a first linkage second end 48. Similarly, the second linkage member 44 extends from a second linkage first end 50 to a second linkage second end 52. The first linkage member 42 is operatively coupled to the first engagement member 30 at the first linkage first end 46. Coupling is made to the bottom side 36 of the first engagement member 30. The second linkage member 44 is operatively coupled to the second engagement member 32 at the second linkage first end 50. Coupling is made to the bottom side 36 of the second engagement member 32. The first linkage member 42 is operatively coupled to the second linkage member 44 at a pivot axis 54 that defines an axis about which the linkage members 42, 44 may pivot relative to each other. In one embodiment, coupling of the linkage members 42, 44 is made at the first linkage second end 48 and the second linkage second end 52.

The connector 40 is operatively coupled to the back plate 22 in a manner that facilitates symmetric movement of the engagement members 30, 32. Specifically, the connector 40 includes a guiding element 56 disposed in engagement with a guiding component 58 of the back plate 22. The guiding element 56 comprises a protrusion that extends from the connector 40 toward the back plate 22. In the illustrated embodiment, the guiding element 56 is integrally formed with, and extends from, the first linkage member 42, however, it is to be appreciated that the guiding element 56 may be formed as part of the second linkage member 44. In one embodiment, the guiding element 56 is co-axially located with the pivot axis 54.

The guiding component 58 of the back plate 22 comprises a slot that is defined by the back plate 22. In the illustrated embodiment, the slot extends completely through the back plate 22, thereby forming an aperture, but it is contemplated that the slot extends only partially through the back plate 22 to form a recess. Regardless of the depth of the guiding component 58, the guiding element 56 of the connector 40 is disposed within the slot in a manner that constrains the direction of movement of the guiding element 56, and therefore the overall connector and the engagement members 30, 32. Specifically, the guiding element 56 is free to travel in the vertical direction 28, thereby preventing any transmission of horizontal forces from engagement member 32 to engagement member 30. Those horizontal forces are absorbed by the safety plate through the walls defining the guiding component 58. Constraint in this manner ensures that the first and second engagement members 30, 32 move symmetrically and without transmitting horizontal forces, in order to achieve desired operation of the safety gear assembly 20.

Advantageously, the safety gear assembly 20 is able to be placed in a compact manner beneath the engagement members 30, 32, while still achieving robust synchronization of the engagement members. This placement has little or no impact in the overall dimensions of the safety gear assembly 20 and a cost reduction is observed, when compared with more complex connector designs associated with safety gear assemblies.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An elevator safety gear assembly comprising:

a base plate having a guiding component;

a first engagement member operatively coupled to the base plate and configured to be positioned on a first side of a guide rail;

a second engagement member operatively coupled to the base plate and configured to be positioned on a second side of the guide rail; and a connector operatively coupled to the first engagement member and the second engagement member for symmetric movement of the first engagement member and the second engagement member relative to the guide rail, the connector having a guiding element disposed in engagement with the guiding component of the base plate, the connector located below the first engagement member and the second engagement member in a vertical direction of the base plate, the vertical direction defined by a direction of travel of an elevator car that the elevator safety gear assembly is coupled to, wherein the connector comprises a first linkage member and a second linkage member, the first linkage member directly coupled to the first engagement member at a first linkage first end, the second linkage member operatively coupled to the second engagement member at a second linkage first end, and the first linkage member and the second linkage member directly coupled to each other at a pivot axis, wherein engagement between the guiding element and the guiding component constrains movement of the guiding element to movement in the vertical direction of the base plate.

2. The elevator safety gear assembly of claim 1, wherein the connector comprises a linkage assembly.

3. The elevator safety gear assembly of claim 1, wherein the pivot axis is located at a first linkage second end and a second linkage second end.

4. The elevator safety gear assembly of claim 1, wherein the guiding element is co-axially located with the pivot axis.

5. The elevator safety gear assembly of claim 1, wherein the guiding element of the connector comprises a protrusion and the guiding component of the base plate comprises a slot defined by the base plate, the guiding element disposed within the slot.

6. The elevator safety gear assembly of claim 5, wherein the slot extends in the vertical direction of the base plate.

7. The elevator safety gear assembly of claim 1, wherein the connector is operatively coupled to the first engagement member and the second engagement member proximate respective lower ends of the first engagement member and the second engagement member in the vertical direction of the base plate.

8. The elevator safety gear assembly of claim 1, wherein the first engagement member and the second engagement member each comprises a wedge member, the wedge members configured to symmetrically engage the guide rail.

9. The elevator safety gear assembly of claim 1, wherein the first engagement member and the second engagement member each comprises a roller member, the roller members configured to symmetrically engage the guide rail.

* * * * *